United States Patent [19]

Levy

[11] 3,976,489

[45]*Aug. 24, 1976

[54] SILVER HALIDE PHOTOGRAPHIC PRODUCTS WITH SEMICONDUCTOR SENSITIZERS

[75] Inventor: Boris Levy, Wayland, Mass.

[73] Assignee: Polaroid Corporation, Cambridge, Mass.

[ * ] Notice: The portion of the term of this patent subsequent to Dec. 3, 1991, has been disclaimed.

[22] Filed: Apr. 8, 1974

[21] Appl. No.: 458,705

Related U.S. Application Data

[63] Continuation-in-part of Ser. No. 237,787, March 24, 1972, abandoned.

[52] U.S. Cl. ..... 96/76 R; 96/3; 96/29 R; 96/29 D; 96/77; 96/108; 96/120

[51] Int. Cl.[2] ..... G03C 1/48; G03C 1/28; G03C 1/02; G03C 1/08

[58] Field of Search ..... 96/76 R, 108, 1 R, 1.5 R, 96/77, 125, 120

[56] References Cited

UNITED STATES PATENTS

| | | | |
|---|---|---|---|
| 2,399,083 | 4/1946 | Waller et al. | 96/108 |
| 2,487,850 | 11/1949 | Carroll | 96/108 |
| 2,597,856 | 5/1952 | Damschroder | 96/108 |
| 2,819,964 | 1/1958 | Jones | 96/108 |
| 2,862,815 | 12/1958 | Sugarman et al. | 96/1.5 R |
| 2,956,882 | 10/1960 | Herold | 96/108 |
| 3,109,737 | 11/1963 | Scott | 96/108 |
| 3,146,104 | 8/1964 | Yackel et al. | 96/76 R |
| 3,219,450 | 11/1965 | Goldberg | 96/94 BF |
| 3,219,451 | 11/1965 | Valle et al. | 96/94 BF |
| 3,219,452 | 11/1965 | Hartouni | 96/94 BF |
| 3,245,833 | 4/1966 | Trevoy | 96/1.5 R |
| 3,297,446 | 1/1967 | Dunn | 96/108 |
| 3,415,644 | 12/1968 | Land | 96/3 |
| 3,615,427 | 10/1971 | Debruyn | 96/29 R |
| 3,649,266 | 3/1972 | Chapman et al. | 96/77 |
| 3,656,962 | 4/1972 | Levy | 96/108 |
| 3,852,067 | 12/1974 | Levy | 96/108 |

*Primary Examiner*—David Klein
*Assistant Examiner*—Richard L. Schilling
*Attorney, Agent, or Firm*—Philip G. Kiely

[57] ABSTRACT

The present invention relates to photography and, more particularly, to a novel radiation recording photographic diffusion transfer process film unit which comprises a photosensitive element which includes, in combination, a particulate dispersion of photosensitive crystals, preferably, photosensitive silver halide crystals adapted to be reduced to silver, upon contact with a silver halide reducing agent, as a function of the crystals' exposure to incident actinic electromagnetic radiation, having associated therewith an inorganic semiconductor adapted to donate electrons to the photosensitive crystals as a function of the exposure of the element to incident actinic electromagnetic radiation.

9 Claims, No Drawings

SILVER HALIDE PHOTOGRAPHIC PRODUCTS WITH SEMICONDUCTOR SENSITIZERS

CROSS-REFERENCE TO OTHER APPLICATIONS

This application is a continuation-in-part of U.S. application Ser. No. 237,787, filed Mar. 24, 1972, now abandoned.

BACKGROUND OF THE INVENTION

1. Field of the Invention

The present invention is directed to providing new and improved radiation recording photosensitive photographic elements.

2. Description of the Prior Art

In accordance with techniques disclosed in the prior art, photosensitive elements and particularly photosensitive silver halide elements may be provided with increased electromagnetic radiation absorption and photochemical response to specified sensitization procedures.

Among such procedures is found a technique categorized, and denoted, as chemical sensitization, wherein a photosensitive element, and particularly a photosensitive silver halide element, may be treated with compounds such as various sulfur compounds, for example, those set forth in U.S. Pat. Nos. 1,574,944; 1,623,499 and 2,410,689; salts of noble metals such as ruthenium, rhodium, palladium, iridium and platinum, all of which belong to Group III of the Periodic Table of Elements and have an atomic weight greater than 100, for example, potassium chloroplatinate, sodium chloropalladite, ammonium chlorohodinate, and the like, in amounts below that which produces any substantial fog inhibition, as described in U.S. Pat. No. 2,488,060; gold salts, for example, potassium aurothiocyanate, potassium chloroaurate, auric trichloride, and the like, as described in U.S. Pat. Nos. 2,597,856 and 2,597,915; reducing agents such as stannous salts, for example, stannous chloride, as described in U.S. Pat. No. 2,487,850, individually or in combination. Such chemical sensitization procedures provide increased response to electromagnetic radiation by the photoresponsive silver halide treated over the frequency range of the inherent, or natural, response characteristics of the crystal.

A second procedure comprises a technique categorized, and denoted, as a spectral, or optical, sensitization procedure, wherein a photosensitive material, and particularly photosensitive silver halide, is provided frequency-selective electromagnetic radiation response characteristics and/or an increase in its inherent, or natural, spectral response characteristics.

In general, such spectral sensitization procedures are accomplished by the adsorption onto one or more surfaces of the photosensitive material of one or more dyes selected from certain classes of dyes including, preferably, cyanine dyes and dyes related to them. For an extensive treatment of cyanine dyes particularly adapted to provide spectral sensitization of, for example, a photosensitive silver halide crystal see Hamer, F. M., *The Cyanine Dyes and Related Compounds*, Interscience Publishers, New York, New York, U.S., (1964).

By means of the traditional procedures disclosed in the art as adapted to accomplish spectral sensitization of photosensitive material, and preferably sensitization of photosensitive silver halide, a cyanine dye in the form of polymeric aggregates is absorbed to the receptive faces, or surfaces, of the photoresponsive material in a statistical monomolecular layer thickness or less. Generally, the cyanine dyes preferably employed for purposes of spectral sensitization comprise an amidinium ion system in which both of the nitrogen atoms are included within separate heterocyclic ring systems, and in which the conjugated chain joining the nitrogen atoms passes through a portion of each heterocyclic ring system. Adsorption is generally believed to be partly accomplished by an unknown type of chemiadsorption between negative crystal surface charges provided, for example, by the excess halide components of the silver halide, and the positive charge of the cyanine chromophore. Adsorption is also favored by the ability to form silver complexes with neclei containing an amidinium nitrogen atom of a selected cyanine dye's heterocyclic ring system, or systems, for example, with a nuclear sulfur, oxygen, or selenium atom, or a second muclear nitrogen atom not directly a component of the amidinium ion system.

As is also known in the prior art, response of photosensitive materials may be extended, that is, the photographic response of photosensitive material within the inherent range of its absorption increased, by the addition of one or more inorganic sensitizing materials.

U.S. Pat. Nos. 3,219,450; 3,219,451; and 3,219,452 teach the sensitization of binder-free silver halide by the use of certain elements of the periodic table classified in Groups I through VI and VIII and V. N. Maslov et al. in *Effect of a Germanium Sol on the Light Sensitivity and the Development of Photographic Layers, Zhur. Nauch. i Prixiad. Fot.* i Kinemotografi 6, 229–31 (1961) discloses the effect of specified semi-conductor materials on photographic plates.

SUMMARY OF THE INVENTION

The present invention is directed to a new diffusion transfer process radiation recording photographic element which comprises a photosensitive element which includes, in combination, a particulate dispersion of photosensitive crystals, preferably, silver halide crystals adapted to be reduced to silver, upon contact with a silver halide reducing agent, as a function of the exposure of the crystals to incident actinic radiation, having associated therewith an inorganic semiconductor which includes one or more elements from Groups IIIa to VIa, inclusive, of the Periodic Table, possessing an atomic number $\geq 14$ and $\leq 81$ adapted to amplify the photosensitivity of the crystals to incident actinic radiation and, associated with the photosensitive element, a diffusion transfer process image-receiving element adapted to receive transfer image-forming material diffusing thereto as a function of the photoexposure of the photographic element.

In a specifically preferred embodiment of the present invention, the inorganic semiconductor is associated with photosensitive silver halide crystals in electron donating relationship and is specifically adapted to donate electrons to the silver halide crystals, as a function of exposure of the element to incident electromagnetic radiation, to thereby selectively induce increased photoresponse to the crystals within and/or without the electromagnetic radiation spectrum range to which the silver halide crystals are inherently responsive.

DETAILED DESCRIPTION OF THE INVENTION

Commensurate with the present invention, enhancement of the photographic action of a photoresponsive diffusion transfer process film unit may be achieved by electron transfer to a photoresponsive material from an associated electron source which comprises an inorganic semiconductor, as described above, adapted to provide electron flow in response to incident electromagnetic radiation.

In general, the absorption of photon excitation derived activating energy, e.g., a photon, by a photoresponsive crystalline material results in the excitation of an electron from a lower energy state to a higher energy state in the structure of the crystal. An excited electronic state is thereby provided to the photoresponsive material resulting in the production of free electrons and sites, where the electrons were situated prior to the impingement of the activating radiation, which act as positively charged particles, i.e., positive "holes".

Silver halide, which itself is a semiconductor, contacted with an activating photon generates an electron moving from the valence band to the conduction band where, in its excited state, it is available to move freely, become trapped and/or contacted by an available interstitial silver ion, i.e., interstitial $Ag^+$ ion, thereby initiating the beginning of latent image formation adapted to be converted to a visible photographic signal.

The thus-formed latent image in the silver halide photoresponsive material is adapted to be developed, or reduced, by conventional procedures of the art to provide a visible species by contact with reagents which will react differentially between with exposed, i.e., possessing latent image, and unexposed photoresponsive material.

This phenomenon of excitation of photoresponsive materials is treated in further detail in the extensive literature of the photographic art, for example, see Mees' *Theory of Photographic Process*, 3rd Edition, MacMillan Company, 1967, Chapter 1, etc.

Photographic action may be considered to be the result observed upon transfer of an electron or energy stimulus to a photosensitive material such as a photosensitive silver halide crystal. Thus, in practice it may be measured by an evaluation of the degree of photochemicial change produced in a given photosensitive material by such a stimulus, which renders individual grains developable thus producing the requisite image formation. The above-indicated stimulus which alters the characteristics of the photosensitive material is transferred to the photosensitive material either directly from incident electromagnetic radiation or from adjuvent adsorbed to or associated with the photosensitive material. Such photographic action is a function of both the quanta of stimulus absorbed and the relative quantum efficiency of the absorbed quanta; the quantum efficiency being considered to be a measure of the quanta which initiate photochemical changes relative to the total quanta absorbed.

A variety of photoresponsive materials are suitable for use in the present invention. The most commonly employed photoresponsive materials are photosensitive metallic halides, such as silver halides, i.e., silver chloride, silver bromide, silver iodide, and mixed halides such as silver iodobromide and silver iodochlorobromide and the like.

The term "photoresponsive" as employed throughout the present specification is thus intended to refer to a material adapted to receive activating energy of selected wavelengths incident thereon which, as a result of the incident radiation, is adapted to undergo modification to provide a photographic signal.

The inorganic semiconductor employed in the present invention provides the aforementioned extension to the photoresponsivity of the selected photoresponsive material, i.e., provide additional electrons to the photoresponsive material as a function of activating energy impinging on the photoresponsive material and/or on the semiconductor. The semiconductor itself thus may also possess the ability to function as an energy transfer bridge, i.e., a conductive material, to not only provide electrons originating therein to the photoresponsive material, but also to accept and transmit externally derived electrons in response to the radiation incident on the photoresponsive material, the semiconductor and/or the medium in which the components are disposed.

Accordingly, the inorganic semiconductor to be employed is adapted to provide electrons to the photosensitive component of the system in response to activating energy impinging on the system. Thus, assuming photons are absorbed directly or indirectly by the photoresponsive component of the system within the scope of the present invention, electrons in the photoresponsive material are made available as free electrons for latent image formation. The inorganic semiconductor provides enhanced responsivity to the photoresponsive material by implementing an electron flow into the photoresponsive material in response to and as a function of the photoexposure. By creating an "electron deficiency" in the photoresponsive component as a function of photoexposure, an electron output is implemented in the organic semiconductor material as a function of the production of the deficiency in the concentration of free electrons in the photoresponsive material; positive "holes" available to attract electrons thereby providing an electron flow directly from the inorganic semiconductor material to the photoresponsive material.

The foregoing description of the mechanism of the photographic system of the present invention has been described with respect to activating energy impinging on the photoresponsive material. It should be understood that electron transfer will result if the activating energy impinges on the semiconductor solely, i.e., the activating energy is of a wavelength absorbed by the semiconductor alone or which may be absorbed by both the photoresponsive material and the semiconductor.

It has been found that the methods of preparing the photoresponsive elements are not critical in the present invention. Binders for the photoresponsive material or the lack thereof are also not critical and the present invention is directed to photoresponsive materials both retained in binder materials, again referring to the photosensitive silver halide in gelatin, for example, or an entirely binderless material, for example, vacuum deposited materials.

By means of the present invention a diffusion transfer process photoresponsive system is thus provided which is capable of photocurrent enchancement leading to latent image formation without the application of an external field. It is found that the sensitization, accordingly, may be interpreted in terms of electronic p-n or n-n′ junction effects. These systems, or devices, are, or function as, solid state diodes.

Specifically, systems of the type described were tested employing silver bromide and iodobromide gelatin emulsions as well as binderless systems, respectively, and an inorganic semiconductor such as aluminum arsenide. In such a system the silver halide is considered to serve as the collector and the aluminum arsenide or the like as the emitter or electron donor.

It should also be understood that in the case where the Fermi level of the semiconductor is higher than the silver halide, thermodynamic equilibration of the two phases will result in equalization of Fermi levels via electron transfer from the semiconductor to the material to be sensitized, thereby leaving the semiconductor positively charged and the silver halide negatively chharged. The negative charge in the silver halide phase may at least partially account for the increase in sensitivity within the inherent absorption band.

Upon exposure to light, within the absorption band of the semiconductor but outside the range of absorption of the silver halide, electrons are raised into the conduction band of the semiconductor. If, after thermodynamic equilibration in the dark, the top of the conduction band of the semiconductor is within KT or higher of the bottom of the conduction band of the silver halide, the electrons can be injected into the silver halide phase, despite the fact that there is an initial positive charge in the semiconductor phase. This can account for spectral sensitization in the above-described silver halide semi-conductor system.

In exposure in the inherent region of the silver halide, the following sequence of events occurs: electron hole pairs are created; electrons enter the conduction band of the silver halide and become trapped; interstitial silver ions migrate to the trapped electrons where they become reduced, thus starting the process of latent image formation. Uncompensated positive holes remain which attract electrons from the semiconductor phase, some of which may contribute to latent image formation in the silver halide. This would account for the increased response in the inherent region of the silver halide due to contact with the semiconductor.

The preferred silver halide dispersions employed for the fabrication of preferred photographic film units comprising photoresponsive silver halide crystals may be prepared by reacting a water-soluble silver salt, such as silver nitrate, with at least one water-soluble halide, such as ammonium, potassium or sodium bromide, preferably together with a corresponding iodide, in an aqueous solution of a peptizing agent such as a colloidal gelatin solution; digesting the dispersion at an elevated temperature, to provide increased crystal growth; washing the resultant dispersion to remove undesirable reaction products and residual water-soluble salts by chilling the dispersion, noodling the set dispersion, and washing the noodles with cold water, or alternatively, employing any of the various flocc systems, or procedures, adapted to effect removal of undesired components, for example, the procedures described in U.S. Pat. Nos. 2,614,928; 2,614,929; 2,728,662; and the like; after-ripening the dispersion at an elevated temperature in combination with the addition of gelatin and/or such other polymeric materials as may be desired and various adjuncts, for example, the previously detailed chemical sensitizing agents and the like; all according to the traditional procedures of the art, as described in Neblette, C. B., *Photography Its Materials and Processes*, 6th Ed., 1962.

Specifically, a gelatino silver iodobromide emulsion prepared as detailed above and comprising a gelatin/silver ratio of about 1:1 and about four mole percent iodide concentration may be chemically sensitized with gold and sulfur as, for example, by the addition, at about 56°C., pH 5 and pAg 9, of an optimally sensitizing amount of a solution comprising 0.1 gram of ammonium thiocyanate in 9.9 cc. of water and 1.2 cc. of a solution containing 0.097 gram of gold chloride in 9.9 cc. of water, and a 0.02 percent aqueous sodium thiosulfate solution.

Specifically, the semiconductor may be provided to the formulation by suspension in particulate form in a liquid medium in which it is insoluble and which is nondeleterious to photographic emulsions, such as water, methanol or other lower molecular weight alcohol, or a mixture of water and alcohol; the suspension so formed is then added to and mixed throughout the above-described formulation.

Alternatively, the silver halide may be precipitated in the presence of the semiconductor in such a way that a core-shell configuration is obtained, with either material, i.e., the silver halide crystal or a semiconductor particle, comprising either the core or the shell.

With respect to semiconductor/silver halide ratio, widely varying ratios have been observed to be effective. In particular, silver halides have been effectively sensitized according to the present inventive concept, by utilizing molar ratios from one silver halide:one semi-conductor to one silver halide:0.01 semiconductor, although higher or lower ratios may be suitable, depending upon emulsion and sensitization characteristics desired.

The particle size of the semiconductor particles has been found not to be critical, except that it will be obvious to those familiar with semiconductor theory that the particle size and configuration must be such as to provide for adequate interfacial contact between the silver halide crystals and semiconductor particles. In practice, sonified suspensions of semiconductor have been found to give particularly good results, since the submicroscopic particles may then in part form a layer on the silver halide crystal. However, it will be appreciated from the foregoing discussion of theoretical considerations that the sensitizing activity of the semiconductor is not dependent upon the formation of an actual semiconductor layer as such; rather, electron transfer can take place readily provided there is at least minimum effective electronic contact between respective reactants. Insofar as silver halide sensitization or photoresponse amplification is concerned, there is no theoretical maximum particle size for the semiconductor. However, the particles should be of sufficiently small size, as well as concentration, so as not to interfere with the photographic characteristics of the silver halide emulsion, as by reflecting and/or scattering incident actinic radiation to any significant extent. Thus, for example, for conventional silver halide emulsion layers having a thickness of about 0.6 to 20 microns wherein the silver halide grains present have an average particle size distribution in the order of 0.1 to 10 microns, it is preferred that the semi-conductor particles be present at an average particle size distribution of 0.1 to 10 microns or less. The smaller the semiconductor particle size, the less the quantity of semiconductor on an absolute weight basis required to increase the sensitivity of a given quantity of a photosensitive silver halide crystalline material. It will be appreciated that absolute numbers as applied to a specific semiconductor particle size and ratio to a silver halide are only meaningful with respect to a single specified silver halide system and that one of ordinary skill in the art possessing the present invention would readily be able to determine empirically the specific parameters which must be utilized to give optimum sensitizing results in the practice of the invention.

It will be recognized that semiconductor particles for use within the scope of the present invention may be readily prepared by any of the conventional techniques, for example, ball mill, sand grinding, ultrasonic, and the like, for the production of particulate solid materials. In general, a wet paste comprising solid semiconductor particles, and optionally, one or more dispersing agents, surfactants, antifoamers, antioxidants, or the like, and water may be processed according to the identified techniques to provide particles of the size desired and the output of the process selected, where desired, may be appropriately filtered to effect removal of any particles which may be present exceeding that of a diameter within the particle size range desired.

Conventional sand grinding techniques adapted to mill solid particles such as to provide the requisite particle size distribution generally comprise agitating an aqueous semiconductor slurry with a sand, which, for example, may possess a size range of 20 to 40 mesh, until the desired particle size distribution is obtained and then separating the semiconductor from contact with the abrasive sand. Commercial mills, of various capacities, adapted to perform sand grinding, may be procured from the Chicago Boiler Company, Chicago, Ill., U.S.

For the preparation of semiconductor material possessing the desired particle size distribution by ultrasonic techniques, an aqueous semiconductor slurry may be treated employing commercial sonifiers such as those procured from Bronson Instruments, Incorporated, Stamford, Conn., U.S.

Preceding, contemporaneous and/or subsequent to the addition of the semiconductor adjuvant, any further desired additives, such as coating aids and the like, may be incorporated in the emulsion and the mixture coated and processed according to the conventional procedures known in the photographic emulsion manufacturing art.

The formulation may then be coated on an appropriate support as, for example, cellulose triacetate film base and the film units thus prepared exposed in a conventional wedge spectrograph to detail wavelength specific sensitivity of the formulation to incident electromagnetic radiation.

Upon processing with a photographic developing composition as, for example, a conventional processing composition of the type commercially distributed by Eastman Kodak Company, Rochester, New York, U.S., under the trade name of "Dektol Developer" and comprising an aqueous alkaline solution of monomethyl-para-amino phenol sulfate and hydroquinone, and a conventional acid stop bath, the resultant spectrograms will detail the sensitivity characteristics of the formulation which may be directly compared with a film unit of the prior art.

As previously detailed, the photoresponsive crystals of the present invention may be employed as the photosensitive component of a photographic emulsion by incorporation within a suitable binder and then coating and processing of the thus prepared emulsion according to conventional procedures known in the photographic manufacturing art.

The photoresponsive crystal material of the photographic emulsion will, as previously described, preferably comprise a crystal of a silver compound, for example, one or more of the silver halides such as silver chloride, silver iodide, silver bromide, or mixed silver halides such as silver chlorobromide, silver iodobromide or silver iodochlorobromide of varying halide ratios and varying silver concentrations.

As examples of semiconductors contemplated for employment in the practice of the present invention, mention may be made of: Ge, AlSb, ZnSe, AlAs, GaAs, InAs, InP, GaP, GaSb, Sn, Si, Ge and SnS.

Particularly preferred semiconductors are those within the class designated which possess a higher conduction band level, and lower band gap energy (the energy difference measured from the top of the valence band of the material selected to the bottom of the material's conduction band).

The fabricated emulsion may be coated onto various types of rigid or flexible supports, for example, glass, paper, metal, polymeric films of both the synthetic types and those derived from naturally occurring products, etc. Especially suitable materials include paper; aluminum; polymethacrylic acid, methyl and ethyl esters; vinyl chloride polymers; polyvinyl acetals; polyamides such as nylon; polyesters such as the polymeric films derived from ethylene glycol terephthalic acid; polymeric cellulose derivatives such as cellulose acetate, triacetate, nitrate, propionate, butyrate, acetate-butyrate, or acetatepropionate; polycarbonates; polystyrenes, etc.

The emulsions may include the various adjuncts, or addenda, according to the techniques disclosed in the art, such as speed increasing compounds of the quaternary ammonium type, as described in U.S. Pat. Nos. 2,271,623; 2,288,226; and 2,334,864; or of the polyethyleneglycol type, as described in U.S. Pat. No. 2,708,162; or of the preceding combination, as described in U.S. Pat. No. 2,886,437; or the thiopolymers, as described in U.S. Pat. No. 3,046,129 and 3,046,134.

The emulsions may also be stabilized with the salts of the noble metals such as ruthenium, rhodium, palladium, iridium and platinum, as described in U.S. Pat. Nos. 2,566,245 and 2,566,263; the mercury compounds of U.S. Pat. Nos. 2,728,663, 2,728,664 and 2,728,665; triazoles of U.S. Pat. No. 2,444,608; the azaindines of U.S. Pat. Nos. 2,444,605; 2,444,606; 2,444,607; 2,444,609; 2,450,297; 2,713,541, 2,716,062; 2,735,769; 2,743,181; 2,756,147; 2,772,164; and those disclosed by Burr in "Wiss. Phot.", Volume 47, 1952, pages 2–28; the disulfides of Belgian Pat. No. 569,317; the benzothiazolium compounds of U.S. Pat. Nos. 2,131,038 and 2,694,716; the zinc and cadmium salts of U.S. Pat. No. 2,839,405; and the mercapto compounds of U.S. Pat. No. 2,819,965.

Hardening agents such as inorganic agents providing polyvalent metallic atoms, specifically polyvalent aluminum or chromium ions, for example, potash alum [$K_2Al_2(SO_4)_4.24H_2O$] and chrome alum [$K_2CR_2(SO_4)_4.24H_2O$] and inorganic agents of the aldehyde type, such as formaldehyde, glyoxal, mucochloric acid, etc.; the detone type such as diacetyl; the quinone type; and the specific agents described in U.S. Pat. Nos. 2,080,019; 2,725,294; 2,725,295; 2,725,305; 2,726,162; 2,732,316; 2,950,197; and 2,870,013, may be incorporated in the emulsion.

The emulsion may also contain one or more coating aids such as saponin; a polyethyleneglycol of U.S. Pat. No. 2,831,766; a polyethyleneglycol ether of U.S. Pat. No. 2,719,087; a taurine of U.S. Pat. No. 2,739,891; a maleopimarate of U.S. Pat. No. 2,823,123; an amino acid of U.S. Pat. No. 3,038,804; a sulfosuccinamate of U.S. Pat. No. 2,992,108; or a polyether of U.S. Pat. No. 2,600,831; or a gelatin plasticizer such as glycerin; a dihydroxyalkane of U.S. Pat. No. 2,960,404; a bis-glycolic acid ester of U.S. Pat. No. 2,904,434; a succinate of U.S. Pat. No. 2,940,854; or a polymeric hydrosol of U.S. Pat. No. 2,852,386.

As the binder for photosensitive crystals, the aforementioned gelatin may be, in whole or in part, replaced with some other colloidal material such as albumin, casein; or zein; or resins such as cellulose derivatives and vinyl polymers such as described in an extensive multiplicity of readily available U.S. and foreign patents.

The fabricated emulsions are to be employed in silver diffusion transfer processes, for example, of the types set forth in U.S. Pat. Nos. 2,352,014; 2,500,421; 2,543,181; 2,563,342; 2,565,376; 2,584,029; 2,584,030; 2,603,565; 2,616,807; 2,635,048; 2,644,756; 2,647,055; 2,662,822; 2,698,236; 2,698,237; 2,698,238; 2,698,245; 2,702,244; 2,704,721; 2,740,715; 2,759,825; 2,774,667; 2,823,122; 2,923,623; 2,938,792; 2,962,377; 2,984,565; 3,003,875; 3,043,690; 3,087,815; 3,087,816; 3,091,530; 3,108,001 and 3,113,866; in additive color diffusion transfer processes, for example, of the types disclosed in U.S. Pat. Nos. 2,614,926; 2,726,154; 2,944,894; 2,992,103 and 3,087,815; and in subtractive color diffusion transfer processes, for example, of the types disclosed in U.S. Pat. Nos. 2,559,643; 2,600,996; 2,614,925; 2,647,049; 2,661,293; 2,698,244; 2,698,798; 2,774,668; 2,802,735; 2,855,299; 2,892,710; 2,909,430; 2,968,554; 2,983,605; 2,983,606; 2,992,104; 2,992,105; 2,992,106; 2,997,390; 3,003,872; 3,015,501; 3,019,104; 3,019,124; 3,022,166; 3,022,167; 3,039,869; 3,043,689; 3,043,692; 3,044,873; 3,047,386; 3,065,074; 3,069,262; 3,069,264; 3,076,808; 3,076,820; 3,077,400; 3,077,402; 3,148,062; 3,227,550; 3,227,551; 3,227,554; 3,243,294; 3,364,022; 3,443,939; 3,443,940; 3,443,941; 3,443,943; 3,415,644; 3,415,645; 3,415,646; 3,473,925; 3,573,042; 3,573,043; 3,573,044; 3,576,625; 3,576,626; 3,578,540; 3,579,333; 3,594,164; 3,594,165; 3,597,197; 3,615,421; 3,619,155; 3,620,724; etc.

The photoresponsive crystals of the present invention may also be employed as the photosensitive component of information recording elements which employ the distribution of a dispersion of relatively discrete photoresponsive crystal, substantially free from interstitial binding agents, on a supporting member such as those previously designated, to provide image recording elements, for example, as described in U.S. Pat. Nos. 2,945,771; 3,142,566; 3,142,567; Newman, *Comment on Non-Gelatin Film*, B.J.O.P., 534, September 15, 1961; and Belgian Pat. Nos. 642,557 and 642,558.

As taught in the art, the concentration of silver halide crystals forming a photographic emulsion and the relative structural parameters of the emulsion layer, for example, the relative thickness, and the like, may be varied extensively and drastically, depending upon the specific photographic system desired and the ultimate employment of the selective photographic system.

In diffusion transfer processes of the present invention, for the formation of positive diffusion transfer process silver images, a latent image contained in an exposed, photosensitive, generally gelatinous, silver halide emulsion is developed and, substantially contemporaneous with development, a soluble silver complex is obtained by reaction of a silver halide solvent with the unexposed and undeveloped silver halide of the emulsion. The resultant soluble silver complex is, at least in part, transported in the direction of a suitable print-receiving element, and the silver of the complex precipitated in such element to provide the requisite positive image definition.

Subtractive color reproduction may be provided by diffusion transfer techniques wherein one or more photoresponsive spectrally selective silver halide elements, having an appropriate subtractive color-providing material associated therewith, are selectively exposed to provide the requisite latent image record formations corresponding to the chromaticity of the selected subject matter and wherein the distribution of color-providing materials, by diffusion, to a suitable image-receiving element, is controlled, imagewise, as a function of the respective latent image record formations. Particularly preferred color-providing materials comprise dye image-forming materials adapted to provide an imagewise distribution of diffusible dye as a function of the point-to-point degree of photosensitive element photoexposure and, in particular, dye image-forming materials which comprise a dye which is a silver halide developing or reducing agent adapted to provide an imagewise distribution of diffusible dye in terms of the unexposed areas of the photosensitive element. An extensive multiplicity of such preferred dyes is disclosed in aforementioned U.S. Pat. No. 2,983,606, and including specifically the copending U.S. applications cross-referenced at column 27 thereof.

The present invention will be illustrated in greater detail in conjunction with the following constructions which set forth representative fabrications of film units of the present invention, which, however, are not limited to the detailed description herein set forth but is intended to be illustrative only.

For purposes of providing comparative efficiency data with respect to selected inorganic semiconductor adjuvants, a silver bromide emulsion may be prepared utilizing solutions which comprise:

| | | |
|---|---|---|
| Solution A (prepared at 60° C.) | | |
| Silver nitrate | 200 gms. | (1.18 moles) |
| Distilled water | 1600 ml. | |
| Solution B (prepared at 70° C.) | | |
| Potassium bromide | 141.4 gms. | (1.19 moles) |
| Solution formed by dissolving 800 gms. of inert gelatin at 40° C. in 8800 ml. of distilled water and controlling the pH at 10; then adding 88 gms. of phthalic anhydride in 616 ml. of acetone | | |

-continued

| | | |
|---|---|---|
| and adjusting the pH to 6 | 226 | gms. |
| Distilled water | 1280 | ml. |

Solution A may be added to solution B with agitation over a 30 minute time period with agitation. Subsequently the emulsion may be cooled to 20°C. and flocculated with 2N $H_2SO_4$ to prepare for washing. Chilled distilled water may then be used to wash the emulsion until the specific conductance of the wash water is under 100 micromhos. After the final wash water is decanted, the emulsion weight may be brought to 450 grams with distilled water and the pH raised to 5.7 with 2N NaOH while mixing constantly to obtain homogeneity. The concentrated emulsion so prepared may be chilled to gel in a shallow covered glass tray, and diced into cubes, after setting, for homogeneous storage.

An aqueous particulate dispersion of silicon may be prepared by sonification of silicon in water with a Branson Sonic Power Company sonifier model J17A for just under two minutes.

To a portion of an emulsion prepared substantially as above equivalent to $9.3 \times 10^{-3}$ moles of silver (one gram) may be added bulk inert gelatin and distilled water, to provide a homogeneous emulsion 6.1% in silver and 13.3% in gelatin. To the resultant emulsion may be added a dispersion of $9.3 \times 10^{-3}$ moles of the silicon in 15 ml. of distilled water prepared above, and the mixture stirred at 42°C. for 2 minutes. One ml. of 1% aqueous Aerosol OT coating aid may then be added, the mixture stirred for 30 seconds, and then cast on cellulose triacetate film base to a coverage of about 300 mg. Ag/ft.$^2$.

A similar procedure was followed with two other portions of the emulsion, each of which contained the equivalent of one gram of silver, with one of the portions being treated with $9.3 \times 10^{-3}$ moles of aluminum antimonide in 15 ml. of distilled water, and the other portion being a control, in that no semiconductor was added along with the 15 ml. of distilled water. Aerosol OT was added to both portions as described above, and the two emulsions so prepared were cast on cellulose triacetate film base to a coverage of 300 mg. Ag/ft.$^2$.

All three emulsions were exposed for approximately two seconds with a tungsten light source of a wedge spectrograph and developed using a Polaroid Corporation Type 42 diffusion transfer system image-receiving element and processing composition, distributed intermediate the photosensitive and receptor elements, with an imbibition period of ten seconds and a processing gap of 0.0022 inch.

A comparison of the action spectra of the respective emulsions as measured on the wedge spectrograph revealed that whereas an emulsion containing no semiconductor additive exhibited a peak at 425 mμ and a long wavelength sensitivity out to about 480 mμ. Emulsions sensitized with Si and with AlSb in a 1:1 molar ratio with respect to silver bromide exhibited sensitivity to longer wavelengths, e.g., 495 mμ and 487 mμ, respectively. Further, extended exposure of the emulsions through a Wratten 93 filter showed no sensitivity in the control emulsions, but the emulsions sensitized with silicon and aluminum antimonide showed a significant long wavelength response.

A gelatino silver halide emulsion comprising, for example, 8 percent silver halide measured as silver and 8 percent gelatin (weight bases) or such other ratio percent as shall be selected may be prepared by adding to a photosensitive silver halide emulsion, prepared as detailed above and comprising, for example, 9.5 percent silver halide measured as silver and 9.5 percent gelatin. To the resultant emulsion may then be added a dispersion of the selected inorganic semiconductor and sufficient water added to provide, for example, a 4.4 percent silver halide and 4.4 percent gelatin emulsion, or such other concentration as is selected, and the emulsion coated on a conventional transparent film base support for the further usage detailed.

The table set forth hereinafter specifically illustrates the advantages to be procured by means of the present invention and details the composition of and photographic results of emulsions prepared in accordance with the precedure detailed above.

Specifically, photosensitive elements prepared as set forth above were exposed in a step wedge spectrometer and also through a Wratten 93 filter and a step wedge with a Xenon source and processed in accordance with silver diffusion transfer processing techniques detailed above employing commercial Type 42 processing reagent and receiving element (Polaroid Corporation, Cambridge, Massachusetts, U.S.A.). In the following table, each step equals 0.3 O.D.

TABLE 1

| Emulsion Composition | Inorganic Semiconductor and Level (moles/mole Ag) | Increase in Relative Photographic Speed (500 mμ) Compared to Control (No Semiconductor) | Increase in Relative Photographic Speed (exposure through KODAK Wratten No. 93 filter) Compared to AgX of No Response |
|---|---|---|---|
| AgBr | AlSb 1/1 | ~ 2 steps | ~ 2 steps |
| AgBr | AlAs 1/1 | ~ 2 steps | ~ 0.5 step |
| AgBr | GaAs 1/1 | ~ 1 step | ~ 1 step |
| AgBr | GaP 1/1 | ~ 1.5 steps | ~ 4 steps |
| AgBr | GaSb 1/1 | ~ 1 step | — |
| AgBr | Ge 1/1 | ~ 2 steps | ~ 3 steps |
| AgBr | InAs 1/1 | ~ 1 step | — |
| AgBr | InP 1/1 | ~ 1.5 steps | ~ 2 steps |
| AgBr | SnS 1/1 | ~ 0.5–1 step | ~ 2 steps |
| AgBr | ZnSe 1/1 | ~ 0.5 step | ~ 4 steps |
| AgBr | Si 1/1 | ~ 2 steps | ~ 2 steps |
| AgBr | Sn 1/1 | ~ 0.5–1 step | — |
| AgBr I (4% $I^-$) | AlSb 1/1 | ~ 1 step | |
| AgBr I (4% $I^-$) | AlAs 1/1 | ~ 1 step | |
| AgBr I (4% $I^-$) | Sn 1/1 | ~ 0.5–1 step | |

TABLE 1-continued

| Emulsion Composition | Inorganic Semiconductor and Level (moles/mole Ag) | Increase in Relative Photographic Speed (500 mμ) Compared to Control (No Semiconductor) | Increase in Relative Photographic Speed (exposure through KODAK Wratten No. 93 filter) Compared to AgX of No Response |
|---|---|---|---|
| AgBr I (4% $I^-$) | Ge 1/1 | ~ 2 steps | |

In the silver transfer processes of the present invention, the processing composition will include an alkaline material, for example, sodium hydroxide, potassium hydroxide, or sodium carbonate, or the like, and most preferably in a concentration providing a pH to the processing composition in excess of about 12, one or more silver halide developing agents, as, for example, of the dihydroxy benzene and/or p-aminophenol type, preferably, and/or one or more silver halide solvents, as, for example, sodium thiosulfate, etc., and/or those agents or solvents disclosed in the previously cited patents and/or referred to herein, and optimally one or more viscosity increasing agents described hereinafter. The processing composition may, where desired, contain the sole silver halide developing agent or agents employed, or a silver halide developing agent in addition to that disposed within the film unit; however, disposition of one or more developing agents in the emulsion and/or a permeable layer directly associated therewith, intermediate the emulsion and a support, may be a particularly preferred embodiment, for the purpose of providing unexposed image acuity, which more readily facilitates directly initiated development at radiation exposed areas of the emulsion without the necessity of diffusing such agents to such sites by means of the processing composition selected.

It will be apparent that the relative proportions of the agents comprising the developing composition set forth herein may be altered to suit the requirements of the operator. Thus, it is within the scope of this invention to modify the herein described developing compositions by the situation of preservatives, alkalis, silver halide solvents, etc., other than those specifically mentioned. When desirable, it is also contemplated to include, in the developing composition, components such as restrainers, accelerators, etc. The concentration of such agents may be varied over a relatively wide range commensurate with the art.

The processing composition solvent employed, however, will generally comprise water and will possess a solvent capacity which does not deleteriously hydrate the selected binder lattices beyond that required to provide the preferred image formation. Accordingly, no adjunct should be included within such composition which deleteriously effects the lattice parameters required for such image formation.

The silver receptor element will generally comprise a distribution of silver precipitating nuclei appropriately positioned within the film unit. In general, such silver precipating nuclei comprise a specific class of adjuncts well known in the art as adapted to effect catalytic reduction of solubilized silver halide specifically including heavy metals and heavy metal compounds such as the metals of Groups IB, IIB, IVA, VIA, and VIII and the reaction products of Groups IB, IIB, IVA, and VIII metals with elements of Group VIA, and may be effectively employed in the conventional concentrations traditionally employed in the art, preferably in a relatively low concentration in the order of about $1 - 25 \times 10^{-6}$ moles/ft.$^2$.

Especially suitable as silver precipitating agents are those disclosed in U.S. Pat. No. 2,698,237 and specifically the metallic sulfides and selenides, there detailed, these terms being understood to include the selenosulfides, the polysulfides, and the polyselenides. Preferred in this group are the so-called "heavy metal sulfides". For best results it is preferred to employ sulfides whose solubility products in an aqueous medium at approximately 20°C. vary between $10^{-23}$ and $10^{-30}$, and especially the salts of zinc, copper, cadmium and lead. Also particularly suitable as precipitating agents are heavy metals such as silver, gold, platinum and palladium and in this category the noble metals illustrated are preferred and are generally provided in the matrix as colloidal particles.

The discrete silver precipitating nuclei layer or layers may be realized by the application of, location of, and/or in situ generation of, the nuclei directly or indirectly contiguous one or both surfaces of the photosensitive layer in the presence or absence of binder or matrix material and, in the latter instance, may comprise one or more adjacent or separated strata of a permeable material contiguous either or both surfaces containing one or more nuclei types disposed in one or more such layers. Matrix materials adapted for such employment may comprise both inorganic and organic materials, the latter type preferably comprising natural or synthetic, processing composition permeable, polymeric materials such as protein materials, for example, glues, gelatins, caseins, etc.; carbohydrate materials, for example, chitins, gums, starches, alginates, etc.; synthetic polymeric materials, for example, of the vinyl or cellulosic types such as vinyl alcohols, amides and acrylamides, regenerated celluloses and cellulose ethers and esters, polyamides and esters, etc., and the like; and the former type preferably comprising submacroscopic agglomerates of minute particles of a water-insoluble, inorganic, preferably siliceous materials such, for example, as silica aerogel as disclosed in U.S. Pat. No. 2,698,237.

As disclosed in aforementioned U.S. Pat. No. 3,415,644, a composite photosensitive structure, particularly adapted for reflection type photographic diffusion transfer subtractive color process employment, which comprises a plurality of essential layers including, in sequence, a dimensionally stable opaque layer; one or more silver halide emulsion layers having associated therewith dye image-providing material which is soluble and diffusible, in alkali, at a first pH, as a function of the point-to-point degree of its associated silver halide emulsion's exposure to incident actinic radiation; a polymeric layer adapted to receive solubilized dye image-providing material diffusing thereto; a polymeric layer containing sufficient acidifying capacity to effect reduction of a processing composition from the first pH to a second pH at which the dye image-providing material is substantially nondiffusible; and a dimensionally stable transparent layer, may be exposed to incident actinic radiation and processed by interposing, intermediate the silver halide emulsion layer and the reception layer, an alkaline processing composition possessing the first pH and containing opacifying agent, which may reflect incident radiation, in a quantity sufficient to mask dye image-providing material associated with the silver halide emulsion.

In a preferred embodiment, the composite photosensitive structure includes a rupturable container, retaining the alkaline processing composition having the first pH and opacifying agent, fixedly positioned extending transverse a leading edge of the composite structure in order to effect, upon application of compressive pressure to the container, discharge of the processing composition intermediate the opposed surfaces of the reception layer and the next adjacent silver halide emulsion.

The liquid processing composition, distributed intermediate the reception layer and the silver halide emulsion, permeates the silver halide emulsion layers of the composite photosensitive structure to initiate development of the latent images contained therein resultant from photoexposure. As a consequence of the development of the latent images, dye image-providing material associated with each of the respective silver halide emulsion layers is individually mobilized as a function of the point-to-point degree of the respective silver halide emulsion layer's photoexposure, resulting in imagewise distributions of mobile dye image-providing materials adapted to transfer, by diffusion, to the reception layer to provide the desired transfer dye image. Subsequent to substantial dye image formation in the reception layer, a sufficient portion of the ions of the alkaline processing composition transfer, by diffusion, to the polymeric neutralizing layer to effect reduction in the alkalinity of the composite film unit to the second pH at which dye image-providing material is substantially nondiffusible, and further dye image-providing material transfer is thereby substantially obviated.

The transfer dye image is viewed, as a reflection image, through the dimensionally stable transparent layer against the background provided by the opacifying agent, distributed as a component of the processing composition, intermediate the reception layer and next adjacent silver halide emulsion layer. The thus-formed opacifying stratum effectively masks residual dye image-providing material retained in association with the silver halide emulsion layer subsequent to processing.

In U.S. Pat. No. 3,415,646, the dimensionally stable layer of the film unit next adjacent the photosensitive silver halide layer or layers is disclosed to be transparent to incident actinic radiation and as disclosed in U.S. Pat. No. 3,415,645, in such instance the opacifying agent may be initially disposed in the film unit intermediate the reception layer and next adjacent silver halide layer.

As disclosed in U.S. Pat. No. 3,615,421 and in the copending U.S. patent application Ser. No. 3646 of Sheldon A. Buckler, filed Jan. 19, 1970, the opacifying component of the film unit may optionally be initially disposed as a preformed processing composition permeable layer, intermediate the reception layer and next adjacent silver halide layer, in a concentration which prior to photoexposure is insufficient to prevent transmission therethrough of exposing actinic radiation and which, subsequent to processing, possesses an opacifying capacity effective to mask residual dye image-providing material retained associated with the film unit's silver halide emulsion layers, and in U.S. Pat. No. 3,647,435, the opacifying component of the film unit may optionally be initially formed in situ, intermediate the reception layer and next adjacent silver halide layer, during photographic processing of the film unit.

In U.S. Pat. No. 3,647,437, the opacifying component is disclosed to optionally comprise a light-absorbing reagent such as a dye which is present as an absorbing species at the first pH and which may be converted to a substantially non-absorbing species at the second pH, and in U.S. Pat. Nos. 3,473,925; 3,573,042 and 3,576,626, opacifying and reflecting component, respectively may be individually interposed intermediate the silver halide layer and reception layer by selective distribution from a composite or a plurality of rupturable containers.

In U.S. Pat. No. 3,573,043, the polymeric neutralizing layer is disclosed to be optionally disposed intermediate the dimensionally stable opaque layer and next adjacent essential layer, i.e., next adjacent silver halide/dye image-providing material component, to effect the designated modulation of film unit's environmental pH; U.S. Pat. No. 3,576,625 discloses the employment of particulate acid distributed within the film unit to effect the modulation of the environmental pH, and U.S. Pat. No. 3,573,044 discloses the employment of processing composition solvent vapor transmissive dimensionally stable layers to effect process modulation of dye transfer as a function of solvent concentration.

Where desired, the film unit may also be constructed in accordance with the disclosure of U.S. Pat. Nos. 3,594,164 and 3,594,165 to comprise a composite photosensitive structure including a transparent dimensionally stable layer carrying a reception layer, a processing composition permeable opaque layer and a photosensitive silver halide layer and the film unit may include a separate dimensionally stable sheet element adapted to be superposed on the surface of the photosensitive structure opposite the dimensionally stable layer and may further include means such as a rupturable container retaining processing composition for distribution of a processing composition intermediate the sheet and photosensitive structure to effect processing. As further disclosed in the last-cited patents, in structures wherein the receptor is positioned next adjacent the transparent layer or the processing composition and/or the sheet is to be separated from the remainder of the film unit subsequent to processing, the latter elements may optionally include opacifying component.

As disclosed in U.S. Pat. No. 3,620,724, the dimensionally stable layer referred to may be opaque and in which instance the photosensitive silver halide layer is positioned next adjacent the opaque support layer and the opacifying component of the film unit's processing composition permeable opaque layer will be disposed in the unit in a concentration insufficient to prevent transmission therethrough of exposing actinic radition and which, subsequent to processing, possesses an opacifying capacity effective to mask residual dye image-providing material retained associated with the silver halide layer, and as disclosed in U.S. Pat. No. 3,647,434, the opacifying agent may be optionally formed in such film unit, in situ, during processing of the unit.

As disclosed in previously cited patents, the liquid processing composition referred to for effecting subtractive color diffusion transfer processes comprises at least an aqueous solution of an alkaline material, for example, diethylamine, sodium hydroxide or sodium carbonate and the like, and preferably possessing a pH in excess of 12, and most preferably includes a viscosity-increasing compound constituting a film-forming material of the type which, when the composition is spread and dried, forms a relatively firm and relatively stable film. The preferred film-forming materials disclosed comprise high molecular weight polymers such as polymeric, water-soluble ethers which are inert to an alkaline solution such as, for example, a hydroxyethyl cellulose or sodium carboxymethyl cellulose. Additionally, film-forming materials or thickening agents whose ability to increase viscosity is substantially unaffected if left in solution for a long period of time are also disclosed to be capable of utilization. As stated, the film-forming material is preferably contained in the processing composition in such suitable quantities as to impart to the composition a viscosity in excess of 100 cps. at a temperature of approximately 24°C. and preferably in the order of 100,000 cps. to 200,000 cps. at that temperature.

As examples of subtractive color image-receiving layers, mention may be made of solution dyeable polymeric layer compositions such as of nylon as, for example, N-methoxymethyl polyhexamethylene adipamide; partially hydrolyzed polyvinyl acetate; polyvinyl alcohol with or without plasticizers; cellulose acetate with filler as, for example, one-half cellulose acetate and one-half oleic acid; gelatin; and other materials of a similar nature. Preferred materials comprise polyvinyl alcohol or gelatin containing a dye mordant such as poly-4-vinylpyridine, as disclosed in U.S. Pat. No. 3,148,061, issued Sept. 8, 1964.

Neutralizing means, for example, a polymeric acid material of the type discussed above may be incorporated, as stated, in the film unit of the present invention, to provide further reduction of the alkalinity of the processing solution in order to advantageously further stabilize and optimize reflectivity of the transfer image. In such instance, the neutralizing layer may comprise particulate acid reacting reagent disposed within the film unit or a polymeric acid layer, for example, a polymeric acid layer approximating 0.3 to 1.5 mils. in thickness, positioned intermediate a support and image-receiving layer, and/or a support and next adjacent emulsion/dye unit layer, and the film unit may also contain a polymeric spacer, or barrier layer, for example, approximating 0.1 to 0.7 mil. in thickness, next adjacent the polymeric acid layer, opposite the respective support layer, as previously described.

Specifically, the film units may employ, but do not require, the presence of a polymeric acid layer such as, for example, of the type set forth in U.S. Pat. No. 3,362,819 which, most preferably, includes the presence of an inert timing or spacer layer intermediate the polymeric acid layer carried on a support and the image-receiving layer.

Since certain changes may be made in the above product without departing from the scope of the invention herein involved, it is intended that all matter contained in the above description shall be interpreted as illustrative and not in a limiting sense.

What is claimed is:

1. A photographic silver diffusion transfer process film unit which comprises a photosensitive element which includes a support, a particulate dispersion of silver halide crystals adapted to be reduced to silver upon contact with a silver halide reducing agent, as a function of said crystals' exposure to incident electromagnetic radiation actinic thereto, having associated therewith in electron donating relationship a sensitizing agent consisting essentially of a water insoluble, inorganic particulate crystalline dispersion of a semi-conductor, said semiconductor comprising one or more elements from Group IIIa to VIa, inclusive, of the Periodic Table of Elements, possessing an atomic number $\geq 14$ and $\leq 81$, said semiconductor adapted to donate electrons to said silver halide crystals as a function of the exposure of said element to incident electromagnetic radiation actinic to said element, said silver halide/semiconductor molar ratio ranging from 1:1 to 1:0.01, and, associated with said photosensitive element, a diffusion transfer process receptor element adapted to receive a silver diffusion transfer process image.

2. A photographic silver diffusion transfer process film unit as defined in claim 1 wherein the top of the conduction band of said semiconductor is equal to or above the bottom of the conduction band of said silver halide crystals.

3. A photographic silver diffusion transfer process film unit as defined in claim 1 wherein said silver halide crystals are selected from a group consisting of silver iodobromide and silver iodochlorobromide crystals.

4. A photographic silver diffusion transfer process film unit as defined in claim 1 wherein said inorganic semiconductor is adapted to extend the range of the electromagnetic radiation spectrum to which said silver halide crystals are responsive.

5. A photographic silver diffusion transfer process film unit as defined in claim 1 wherein said inorganic semiconductor comprises an inorganic photoconductor.

6. A photographic silver diffusion transfer process film unit as defined in claim 1 wherein said silver halide crystals and said inorganic semiconductor are disposed in a polymeric matrix.

7. A photographic silver diffusion transfer process film unit as defined in claim 6 wherein said polymeric matrix comprises gelatin.

8. A photographic silver diffusion transfer process film unit as defined in claim 7 including associated therewith a silver halide developing agent.

9. A photographic silver diffusion transfer process film unit as defined in claim 1 wherein said inorganic semiconductor is AlSb.

* * * * *

UNITED STATES PATENT OFFICE

CERTIFICATE OF CORRECTION

Patent No. 3,976,489 Dated August 24, 1976

Inventor(s) Boris Levy

It is certified that error appears in the above-identified patent and that said Letters Patent are hereby corrected as shown below:

Column 18, line 20, "IIia" should be --IIIa--.

Signed and Sealed this

Twenty-third Day of November 1976

[SEAL]

*Attest:*

RUTH C. MASON
*Attesting Officer*

C. MARSHALL DANN
*Commissioner of Patents and Trademarks*